US007077078B2

(12) United States Patent
Yuasa et al.

(10) Patent No.: US 7,077,078 B2
(45) Date of Patent: Jul. 18, 2006

(54) ENGINE COOLING STRUCTURE

(75) Inventors: Tsuneyoshi Yuasa, Kobe (JP); Masanori Kobayashi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/941,880

(22) Filed: Sep. 16, 2004

(65) Prior Publication Data

US 2005/0061265 A1 Mar. 24, 2005

(30) Foreign Application Priority Data

Sep. 19, 2003 (JP) ..... 2003-327906

(51) Int. Cl.
*F01P 1/02* (2006.01)

(52) U.S. Cl. ..... 123/41.7; 123/198 E

(58) Field of Classification Search ..... 123/41.7, 123/41.56, 198 E
See application file for complete search history.

(56) References Cited

U.S. PATENT DOCUMENTS 6,079,374 A * 6/2000 Yamamoto et al. ..... 123/41.7

FOREIGN PATENT DOCUMENTS

JP 2002-303148 10/2002

* cited by examiner

*Primary Examiner*—Tony M. Argenbright
*Assistant Examiner*—Katrina Harris
(74) *Attorney, Agent, or Firm*—Oliff & Berridge, PLC

(57) ABSTRACT

In an engine cooling structure, an engine cover defines together with a cylinder a space connected through a cooling air inlet to a cooling air supply device. An exhaust muffler has an exhaust gas discharge opening formed near a back end part of a side, which is opposite to a side facing the cylinder, of the exhaust muffler. The opening is positioned at a height included in a vertical dimension of the cylinder. A cooling air passage, through which a cooling air taken in the space defined by the engine cover and the cylinder through the cooling air inlet flows, is formed so as to cool the cylinder and the exhaust muffler. The cooling air passage includes a main cooling passage for guiding part of cooling air used for cooling the cylinder through a space around the exhaust muffler to a space around the opening, and a cooling air bypass passage for guiding part of cooling air used for cooling the cylinder directly to the space around the opening.

6 Claims, 7 Drawing Sheets

ENGINE COOLING STRUCTURE

BACKGROUND OF THE INVENTION

1. Field of the Invention

The present invention relates to an engine cooling structure, and more particularly, to an engine cooling structure suitable for cooling a portable engine having a cylinder provided with an exhaust port, and an exhaust muffler connected to the exhaust port, and suitable for driving a backpack blower, a backpack power applicator or a hand held bush cutter.

2. Description of the Related Art

A portable engine for various work machines such as mentioned above is requested to cool its cylinder and exhaust muffler and to discharge an exhaust gas of the lowest possible temperature. Various previously proposed engine cooling structures are devised to use cooling air efficiently by properly controlling the flow of cooling air.

FIGS. 7 and 8 show a cooling structure disclosed in JP-A No. 2002-303148 applied to a portable engine for driving a backpack blower A shown in FIG. 6. Referring to FIG. 6, the backpack blower A includes an engine E, a blower 1, a back frame 15 holding the engine E and the blower 1, a flexible pipe 16 connected to the discharge pipe of the blower 1, a duct 17, and a nozzle 18. An operator supports the back frame 15 holding the engine E and the blower 1 on the operator's shoulders by straps 19 connected to the back frame 15. Air is blown through the nozzle 18 to blow and collect dead leaves M and trash.

Referring to FIG. 7 showing the blower 1 and the engine E in a schematic plan view, the blower 1 has a fan 2 and a fan casing 3 housing the fan 2. The engine E for driving the fan 2 has a cylinder 8 and is joined to a back part of the fan casing 3. The cylinder 8 of the engine E is disposed behind the fan casing 2 opposite to a cooling air inlet opening 10 formed in the back wall 3*a* of the fan casing 3. An exhaust muffler 11 is connected to the right side of the cylinder 8, and a carburetor 12 and an air cleaner 13 are connected in that order to the left side of the cylinder 8.

Spaces extending over the cylinder 8, and the left and the back side of the cylinder 8 are covered with a cylinder cover 100 formed by processing a metal sheet. Spaces extending over the exhaust muffler 11, and the right and the front side of the exhaust muffler 11 are covered with muffler covers 101 and 102. A shroud 103 is disposed outside the muffler cover 101 as indicated by imaginary lines in FIG. 7.

As shown in FIG. 8, the exhaust muffler 11 is provided in it's lower end part with an exhaust gas discharge opening 110.

In the portable engine E shown in FIG. 7, cooling air is taken from the fan casing 3 through the cooling air inlet opening 10 into the space around the cylinder 8. The cooling air flows into a space around the exhaust muffler 11 after cooling the cylinder 8 to cool the exhaust muffler 11. Then, the cooling air is discharged backward together with the exhaust gas through an opening formed in the shroud 103 shown in FIG. 7.

The cooling structure shown in FIGS. 7 and 8 can efficiently cool the cylinder 8 and the exhaust muffler 11. However, the cooling air is used first for cooling the cylinder 8, and flows through the space around the exhaust muffler 11 to cool the exhaust muffler 11 and is discharged outside together with the exhaust gas. Therefore, it is difficult to decrease the temperature of the exhaust gas discharged through the exhaust gas discharge opening 110.

Flanges 115 forming caulked joints and protruding from the outer surface of the exhaust muffler 11 impede the flow of the cooling air flowing along the upper surface of the exhaust muffler 11.

SUMMARY OF THE INVENTION

Accordingly, it is an object of the present invention to provide an engine cooling structure for cooling a portable engine, capable of efficiently using cooling air blown by a fan or the like for cooling the cylinder and the exhaust muffler of the portable engine and of decreasing the temperature of the exhaust gas discharged through the exhaust gas discharge opening of the exhaust muffler.

According to one aspect of the present invention, in an engine cooling structure for an engine including a cylinder, an exhaust muffler connected to the cylinder, and an engine cover covering the cylinder and the exhaust muffler, the engine cover defines together with the cylinder a space connected through a cooling air inlet to a cooling air supply device. The exhaust muffler has an exhaust gas discharge opening formed near a back end part of a side, which is opposite to a side facing the cylinder, of the exhaust muffler, the exhaust gas discharge opening being positioned at a height included in a vertical dimension of the cylinder. A cooling air passage, through which a cooling air taken in the space defined by the engine cover and the cylinder through the cooling air inlet flows, is formed so as to cool the cylinder and the exhaust muffler, the cooling air passage including a main cooling passage for guiding part of the cooling air used for cooling the cylinder through a space around the exhaust muffler to a space around the exhaust gas discharge opening of the exhaust muffler, and a cooling air bypass passage for guiding part of the cooling air used for cooling the cylinder directly to the space around the exhaust gas discharge opening of the exhaust muffler.

Preferably, the cooling air inlet is disposed opposite to the cylinder. The exhaust muffler is provided on its upper surface with a cooling air guide ridge extending from a position near the cooling air inlet to a position near the exhaust gas discharge opening of the exhaust muffler.

Preferably, the exhaust muffler has a muffler case formed from a pair of half muffler cases by joining together flanges formed along brims of the pair of half muffler cases, the flanges joined together forming the cooling air guide ridge.

Preferably, a shroud covers the engine cover so as to form the cooling air bypass passage between the shroud and a part, which covers a back part of the cylinder, of the engine cover.

According to another aspect of the present invention, in an engine cooling structure for an engine including a cylinder, an exhaust muffler connected to the cylinder, and an engine cover covering the cylinder and the exhaust muffler, the engine cover defines together with the cylinder a space connected through a cooling air inlet to a cooling air supply device. The exhaust muffler has an exhaust gas discharge opening formed near a back end part of a side, which is opposite to a side facing the cylinder, of the exhaust muffler, the exhaust gas discharge opening being positioned at a height included in a vertical dimension of the cylinder. The cooling air inlet is disposed opposite to the cylinder. The exhaust muffler is provided on its upper surface with a cooling air guide ridge extending from a position near the cooling air inlet to a position near the exhaust gas discharge opening of the exhaust muffler.

Preferably, the exhaust muffler has a muffler case formed from a pair of half muffler cases by joining together flanges formed along brims of the pair of half muffler cases, the flanges joined together forming the cooling air guide ridge.

In the present invention, the cooling air bypass passage guides part of the cooling air used for cooling the cylinder directly to the space around the exhaust gas discharge opening of the exhaust muffler while bypassing the exhaust muffler, and/or the cooling air guide ridge formed on the upper surface of the exhaust muffler guides the cooling air flowing along the upper surface of the exhaust muffler to the exhaust gas discharge opening. Consequently, the discharged exhaust gas can be positively cooled to decrease the temperature of the exhaust gas.

Since the exhaust gas discharge opening of the exhaust muffler has the height included in the vertical dimension of the cylinder, the cooling air used for cooling the cylinder and flowing around the exhaust muffler can be guided effectively toward the exhaust gas discharge opening, and the cooling air thus guided to the exhaust gas discharge opening has high capacity to cool the exhaust gas.

Since the joined flanges of the pair of half muffler cases serves as the cooling air guide ridge, any additional machining cost is not necessary for forming the cooling air guide ridge.

BRIEF DESCRIPTION OF THE DRAWINGS

The above and other objects features and advantages of the present invention will become more apparent from the following description taken in connection with the accompanying drawings, in which.

DESCRIPTION OF THE PREFERRED EMBODIMENTS

Figure 4:
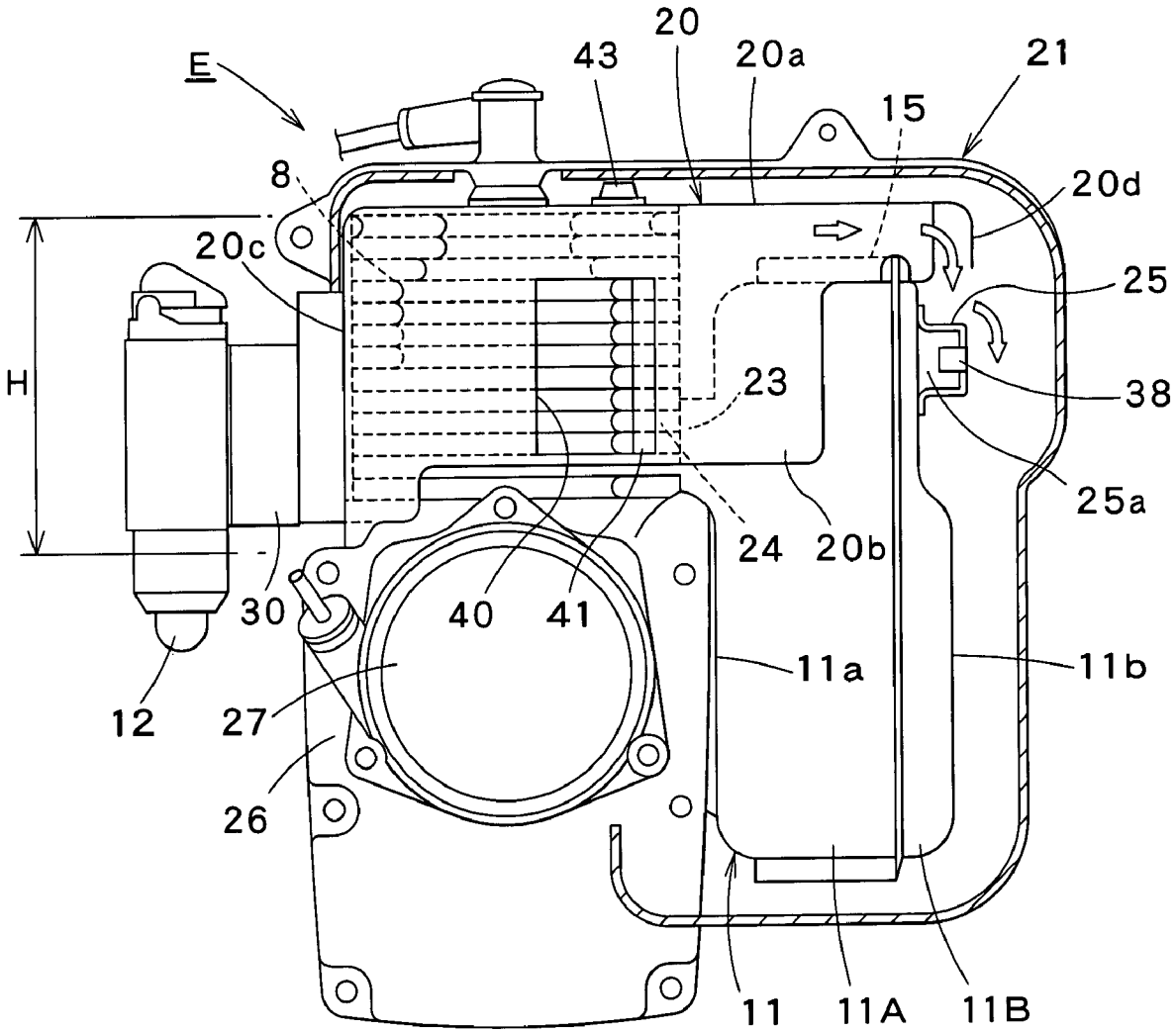
FIG. 4 is a rear view of the engine shown in FIG. 1, in which the outer shroud is cut on a vertical plane.
Figure 5:
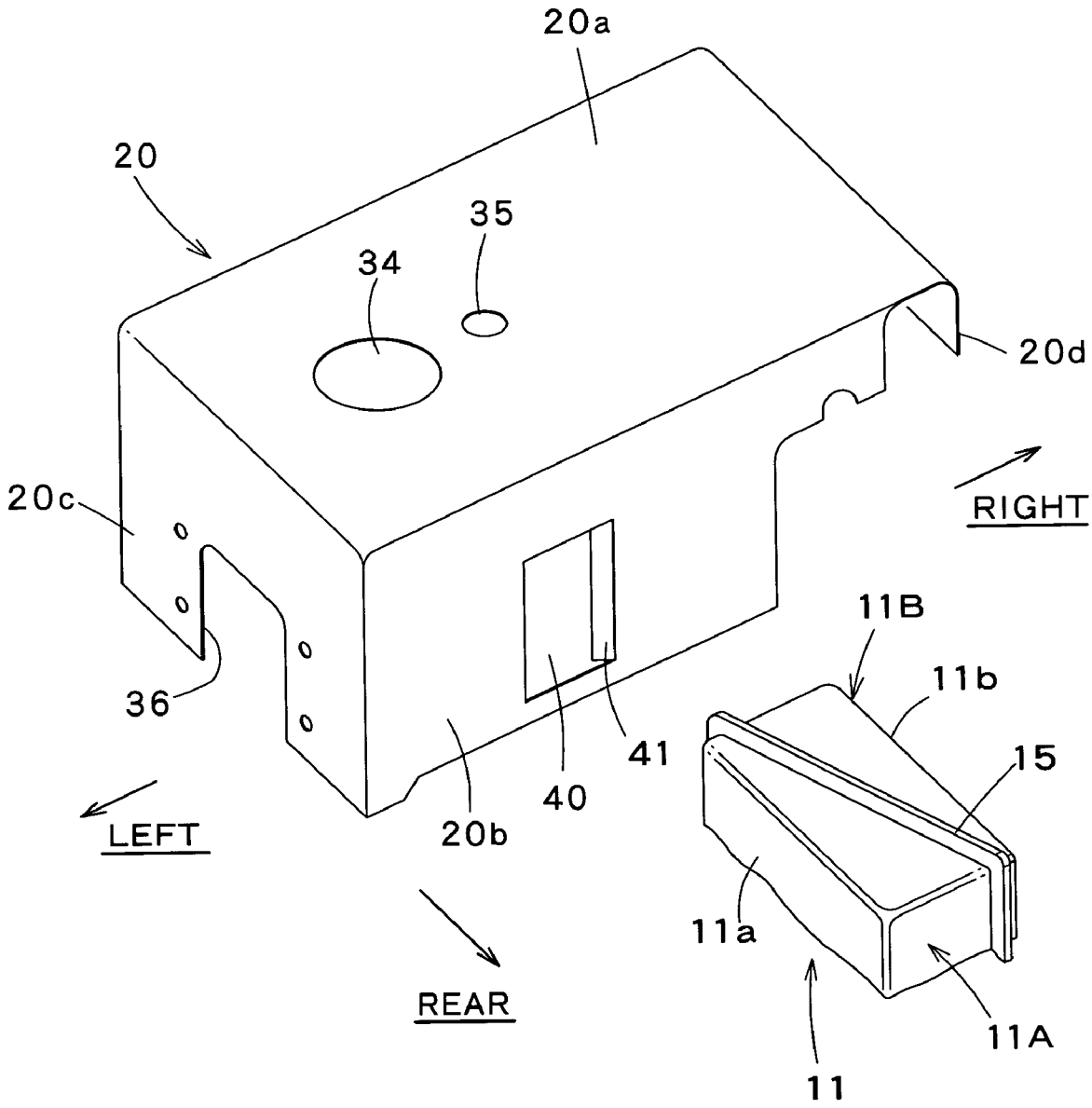
FIG. 5 is a fragmentary, exploded perspective view of an engine cover and an exhaust muffler.
Figure 6:
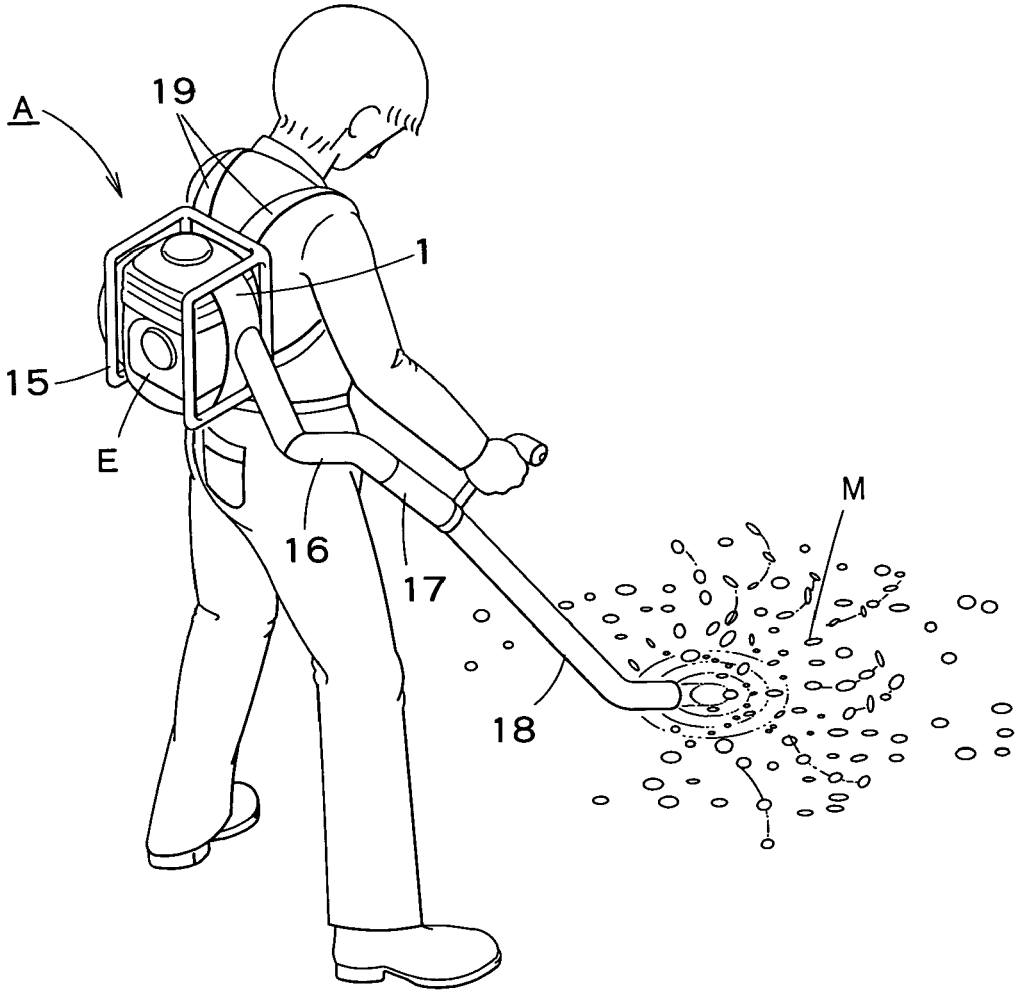
FIG. 6 is a perspective view of a backpack blower carried on operator's shoulders for operation.

FIGS. 1 to 5 show an engine provided with an engine cooling structure in a preferred embodiment according to the present invention for driving a backpack blower A as shown in FIG. 6.

Blower and Engine

Figure 1:
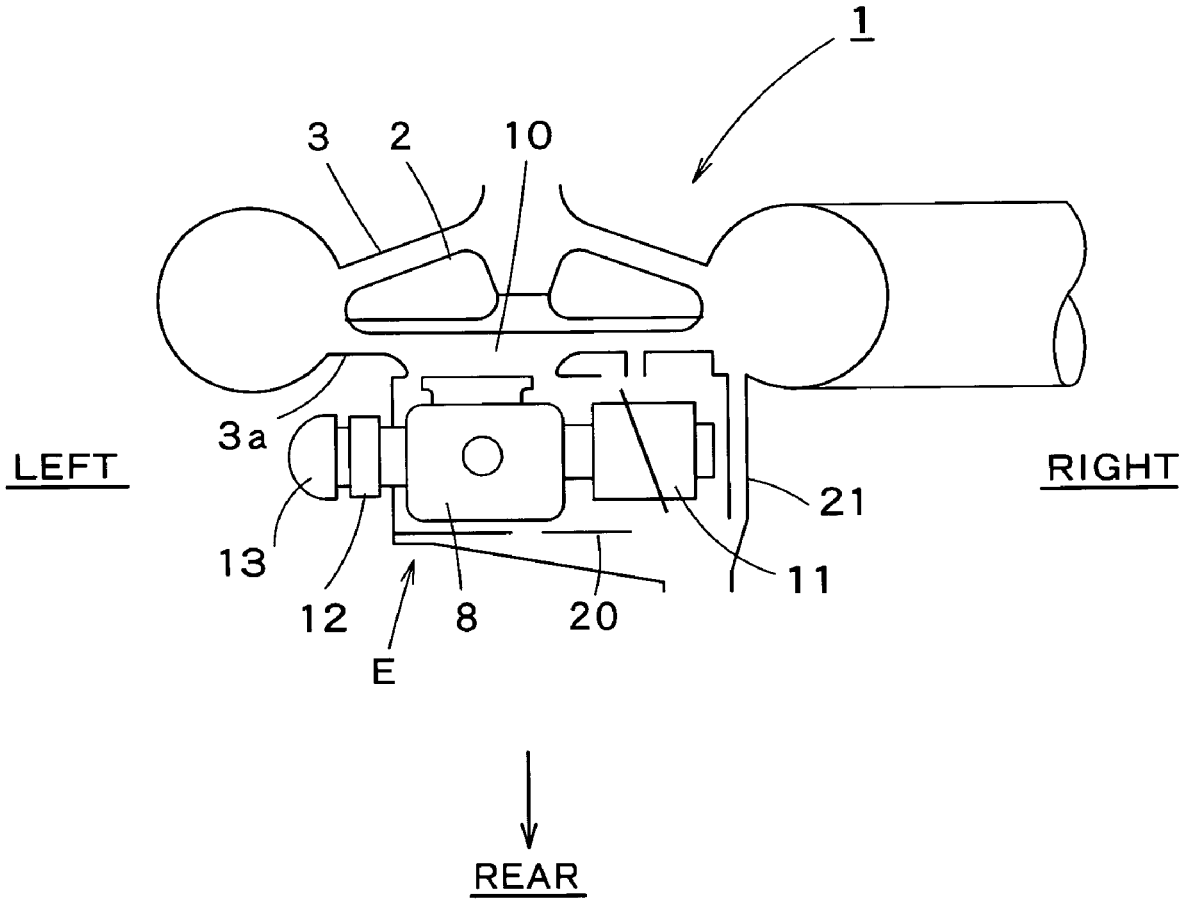
FIG. 1 is a schematic plan view of a blower and an engine provided with an engine cooling structure in a preferred embodiment according to the present invention.
Figure 7:
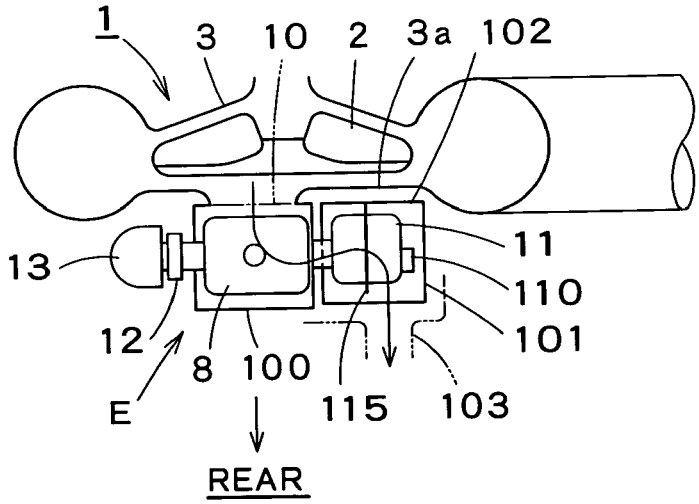
FIG. 7 is a schematic plan view of an assembly of a blower and an engine as a related art.
Figure 8:
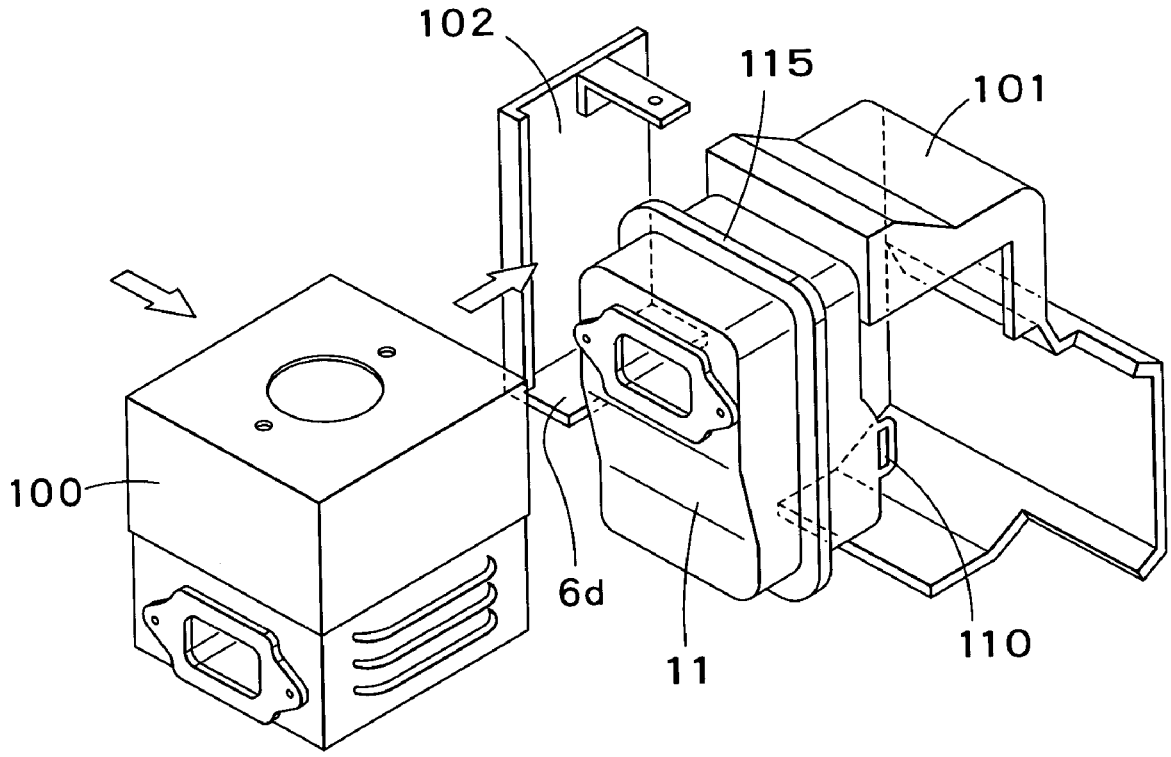
FIG. 8 is an exploded perspective view of an engine cover shown in FIG. 7.

Referring to FIG. 1, a blower 1 includes a fan 2 and a fan casing 3. An engine E having a cylinder 8 for driving the fan 2 is joined to a back part of the fan casing 3. The cylinder 8 of the engine E is disposed behind a back wall 3*a* of the fan casing 3 opposite to a cooling air inlet opening 10 formed in the back wall 3*a*. An exhaust muffler 11 is connected at its left side wall 11*a* (see FIG. 3) to the right side of the cylinder 8, and a carburetor 12 and an air cleaner 13 are connected in that order to the left side of the cylinder 8. The blower 1 is basically the same as that shown in FIG. 7.

The engine E is provided with an engine cover 20 covering the cylinder 8 and the exhaust muffler 11 and formed by processing a metal sheet. The engine cover 20 is covered with an outer shroud 21 of a resin.

Engine and Exhaust Muffler

Referring to FIG. 4 showing the engine E in a rear view, in which the outer shroud 21 is cut on a vertical plane, an exhaust gas inlet opening 23 formed in a left side wall 11*a* of the exhaust muffler 11 is connected to an exhaust port 24 formed in the right side of the cylinder 8. An exhaust tail pipe (exhaust deflector) 25 is attached to a part, at a height higher than the height of the exhaust port 24 and included in the vertical dimension H of the cylinder 8, of a right side wall 11*b*, not facing the cylinder 8, of the exhaust muffler 11. A crankcase 26 is joined to the bottom of the cylinder 8. A recoil starter 27 is held on the back wall of the crankcase 26. The carburetor 12 is connected to the intake port of the cylinder 8 by an intake pipe 30 serving also as an insulator.

Figure 3:
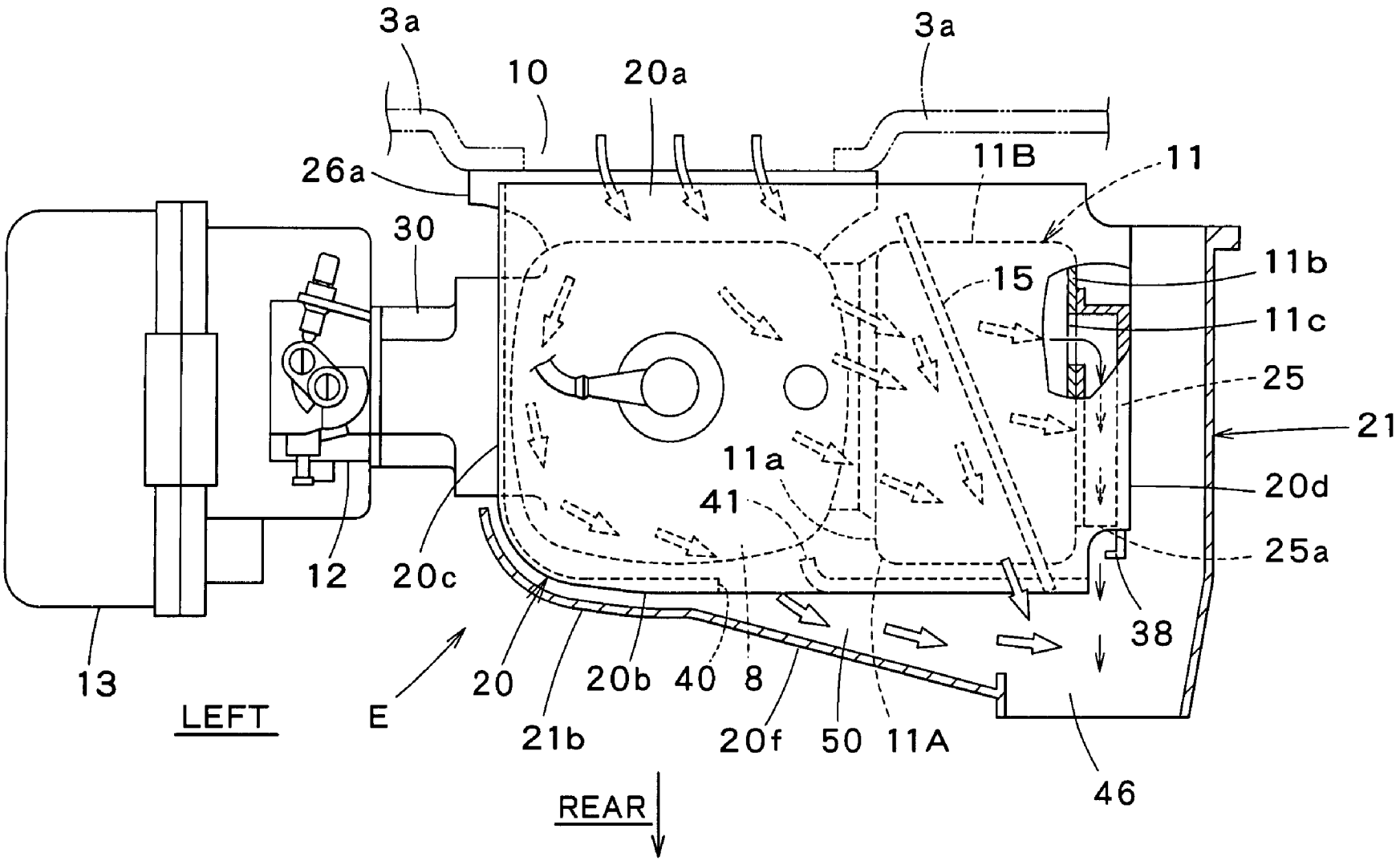
FIG. 3 is a plan view of the engine shown in FIG. 1, in which an outer shroud is cut on a horizontal plane.

Referring to FIG. 3 showing the engine E in a plan view, in which the outer shroud 21 is cut on a horizontal plane, a joining part 26*a* formed on the front end of the crankcase 26 is fastened to the back wall 3*a* of the fan casing 3. The exhaust muffler 11 has an outer case formed by joining together and caulking flanges 15 having parting surfaces and formed along the brims of a right half case 11B and a left half case 11A. The half cases 11A and 11B have the shape of a pan. The joined flanges 15 form a continuous cooling air guide ridge extending backward obliquely to the right as viewed from above the exhaust muffler 11. In more detail, the flanges 15 forming the cooling air guide ridge guides the cooling air flowing along the upper surface of the exhaust muffler 11 from a vicinity of the cooling air inlet opening 10 at the front left-hand side of the exhaust muffler 11 to a vicinity of an exhaust gas discharge opening 25*a* at the back end of the exhaust tail pipe 25. An L-shaped collision plate 38 is formed integrally with the tail pipe at the exhaust gas discharge opening 25*a*.

The exhaust tail pipe 25 is extended backward from an exhaust gas introducing opening 11*c*, which is formed in the right side wall 11*b* of the exhaust muffler 11, along the side surface of the exhaust muffler 11 to guide the exhaust gas backward from the exhaust gas introducing opening 11*c* as indicated by the arrows. The exhaust gas discharge opening 25*a* is formed at the back end of the exhaust tail pipe 25 so as to open backward in the vicinity of the back end of the exhaust muffler 11.

Engine Cover

Referring to FIG. 5 showing the engine cover 20 in a perspective view, the engine cover 20 is a unitary structure formed by processing a metal sheet and has an upper wall 20*a*, a back wall 20*b* and a left wall 20*c*. A right end part of the upper wall 20*a* is bent downward to form an end wall 20*d*. The upper wall 20*a* is provided with an ignition plug inserting hole 34 and a bolt hole 35. The left side wall 20*c* is provided with a mounting hole 36. The back wall 20*b* is provided with a bypass opening 40. A part, defining the right edge of the bypass opening 40, of the back wall 20*b* is bent obliquely forward to form a guide wall 41. A right part of the back wall 20*b* is cut to form a recess for receiving the exhaust muffler 11.

Referring to FIG. 4, the engine cover 20 covers the cylinder 8 and the exhaust muffler 11 from above the cylinder 8 and the exhaust muffler 11. The upper wall 20*a* is fastened to an upper part of the cylinder 8 with a bolt 43. The left wall 20*c* is fastened together with the intake pipe 30 serving also as an insulator to the left side of the cylinder 8. The right end wall 20*d* lies near and above the right end of the tail pipe 25. The right end wall 20*d* deflects the flow of the cooling air flowing rightward along the upper surface of the exhaust muffler 11 downward toward the tail pipe 25, as viewed in FIG. 4. The bypass opening 40 formed in the back wall 20*b* lies behind the cylinder 8 so as to correspond to a right half part of the cylinder 8.

Outer Shroud

Figure 2:
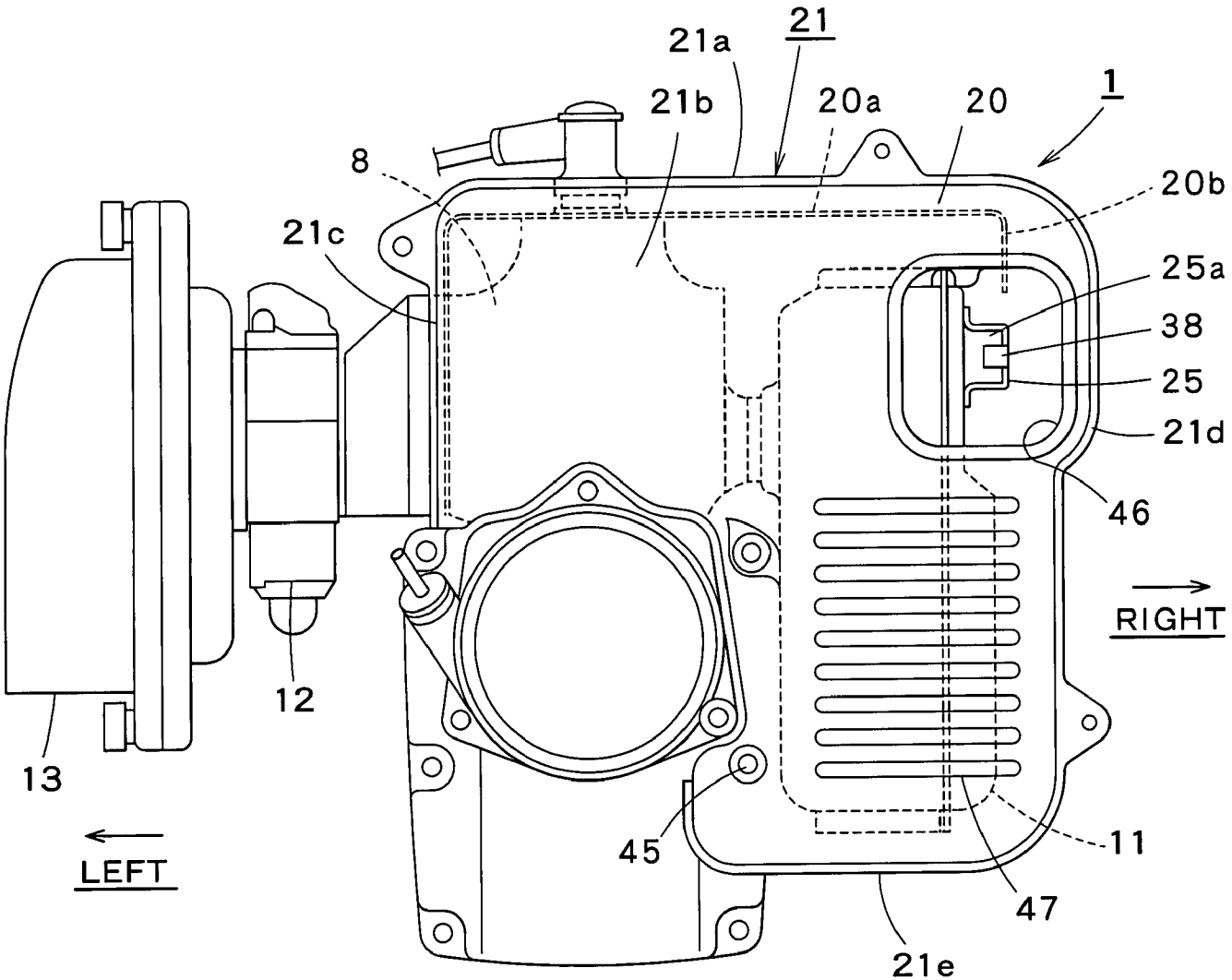
FIG. 2 is a rear view of the engine shown in FIG. 1.

Referring to FIG. 2, the outer shroud 21 is a unitary structure formed of a resin and having an upper wall 21*a*, a back wall 21*b*, a left side wall 21*c*, a right side wall 21*d*, and a lower wall 21*e* covering the exhaust muffler 11 from below the exhaust muffler 11. The outer shroud 21 is fastened to the back surface of the engine E with bolts 45. The back wall 21*b* is provided with a discharge opening 46 lying behind and corresponding to the exhaust gas discharge opening 25*a* of the tail pipe 25, and a plurality of slots 47 in a part below the discharge opening 46.

Referring to FIG. 3, the back wall 21*b* of the outer shroud 21 has an oblique part 20*f* extending obliquely backward from a position corresponding to the bypass opening 40 of the engine cover 20 to the discharge opening 46. The oblique part 20*f*, the back wall 20*b* of the engine cover 20 and the bypass opening 40 form a cooling air bypass passage 50.

Operation

Referring to FIG. 1, the cooling air supplied from the fan casing 3 of the blower 1 through the cooling air inlet opening 10 into the space covered with the engine cover 20 flows through spaces over and around the cylinder 8 as indicated by blank arrows in FIG. 3 to cool the cylinder 8.

The cooling air flowing over the cylinder 8 flows into a space over the exhaust muffler 11 to cool the upper wall of the exhaust muffler 11. Part of the cooling air is guided by flanges 15 forming the cooling air guide ridge so as to flow obliquely backward toward the right into a space around the exhaust gas discharge opening 25*a* of the tail pipe 25, and cools the exhaust gas discharged through the exhaust gas discharge opening 25*a*. The rest of the cooling air flows rightward over flanges 15 forming the cooling air guide ridge and is deflected so as to flow downward by the end wall 25*d* to cool the tail pipe 25.

The cooling air flowing along the left side of the cylinder 8 flows along the back side of the cylinder 8, flows through the bypass opening 40 into the bypass passage 50, and flows into a space around the exhaust gas discharge opening 46 of the outer shroud 21 to cool the exhaust gas immediately after the exhaust gas has been discharged from the tail pipe 25.

Thus, the exhaust gas can be positively cooled to a lower temperature by both the cooling air guided by the flanges 15 so as to flow along the upper surface of the exhaust muffler 11, and the cooling air flowing from the cylinder 8 through the bypass passage 50 to the discharge opening 46 while bypassing the exhaust muffler 11.

The exhaust gas discharged through the exhaust gas discharge opening 25*a* of the tail pipe 25 impinges against and is scattered by the collision plate 38. Consequently, the dynamic power of the exhaust gas is reduced, the scattered exhaust gas is efficiently mixed with the cooling air, whereby exhaust gas cooling efficiency can be improved.

The exhaust gas discharged through the exhaust gas discharge opening 25*a* and the discharge opening 46 is cooled concentratedly by the cooling air. Consequently, the rise of the temperatures of dead leaves and trash flying around the engine can be prevented. The engine cover 20 and the outer shroud 21 exercise a heat-insulating effect of screening heat generated by the engine E, and intercept the propagation of noise generated by the exhaust muffler 11 and the cylinder 8.

The cooling air guide ridge may be formed from a guide plate attached to the upper wall of the exhaust muffler 11 instead of from the flanges 15.

The engine cover 20 may be formed of a heat-resistant resin instead of being formed by processing a metal plate.

Although the engine cooling structure in the foregoing embodiment has been described as applied to the portable engine for driving a backpack blower, the present invention is applicable to portable engines for other work machines, such as backpack power applicators, hand held bush cutters and various hand work machines. When the engine cooling structure is applied to such work machines other than the backpack blower, the engine needs a cooling fan for blowing cooling air.

The present invention is applicable to portable engines for other purposes.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An engine cooling structure for an engine including a cylinder, an exhaust muffler connected to the cylinder, and an engine cover covering the cylinder and the exhaust muffler, wherein:

the engine cover defines together with the cylinder a space connected through a cooling air inlet to a cooling air supply device;

the exhaust muffler has an exhaust gas discharge opening formed near a back end part of a side, which is opposite to a side facing the cylinder, of the exhaust muffler, the exhaust gas discharge opening being positioned at a height included in a vertical dimension of the cylinder; and a cooling air passage, through which a cooling air taken in the space defined by the engine cover and the cylinder through the cooling air inlet flows, is formed so as to cool the cylinder and the exhaust muffler, the cooling air passage including a main cooling passage for guiding part of the cooling air used for cooling the cylinder through a space around the exhaust muffler to a space around the exhaust gas discharge opening of the exhaust muffler, and a cooling air bypass passage for guiding part of the cooling air used for cooling the cylinder directly to the space around the exhaust gas discharge opening of the exhaust muffler.

2. The engine cooling structure according to claim 1, wherein:

the cooling air inlet is disposed opposite to the cylinder; and the exhaust muffler is provided on its upper surface with a cooling air guide ridge extending from a position near the cooling air inlet to a position near the exhaust gas discharge opening of the exhaust muffler.

3. The engine cooling structure according to claim 1, wherein the exhaust muffler has a muffler case formed from a pair of half muffler cases by joining together flanges formed along brims of the pair of half muffler cases, the flanges joined together forming the cooling air guide ridge.

4. The engine cooling structure according to claim 2, wherein a shroud covers the engine cover so as to form the cooling air bypass passage between the shroud and a part, which covers a back part of the cylinder, of the engine cover.

5. An engine cooling structure for an engine including a cylinder, an exhaust muffler connected to the cylinder, and an engine cover covering the cylinder and the exhaust muffler, wherein:

the engine cover defines together with the cylinder a space connected through a cooling air inlet to a cooling air supply device;

the exhaust muffler has an exhaust gas discharge opening formed near a back end part of a side, which is opposite to a side facing the cylinder, of the exhaust muffler, the exhaust gas discharge opening being positioned at a height included in a vertical dimension of the cylinder;

the cooling air inlet is disposed opposite to the cylinder; and the exhaust muffler is provided on its upper surface with a cooling air guide ridge extending from a position near the cooling air inlet to a position near the exhaust gas discharge opening of the exhaust muffler.

6. The engine cooling structure according to claim 5, wherein the exhaust muffler has a muffler case formed from a pair of half muffler cases by joining together flanges formed along brims of the pair of half muffler cases, the flanges joined together forming the cooling air guide ridge.

* * * * *